United States Patent [19]

Kitajima et al.

[11] 4,365,015

[45] Dec. 21, 1982

[54] PHOTOSENSITIVE MEMBER FOR ELECTROPHOTOGRAPHY COMPOSED OF A PHOTOCONDUCTIVE AMORPHOUS SILICON

[75] Inventors: Nobuo Kitajima, Toride; Shunichi Ishihara, Kodaira; Yuji Nishigaki, Kawasaki; Nobuko Kitahara, Tokyo, all of Japan

[73] Assignee: Canon Kabushiki Kaisha, Tokyo, Japan

[21] Appl. No.: 177,118

[22] Filed: Aug. 11, 1980

[30] Foreign Application Priority Data

Aug. 20, 1979 [JP] Japan ..... 54-105671
Aug. 21, 1979 [JP] Japan ..... 54-106759

[51] Int. Cl.[3] ..... G03G 5/08; G03G 5/14

[52] U.S. Cl. ..... 430/62; 430/66; 430/69; 430/84; 204/192 P

[58] Field of Search ..... 430/84, 69, 60, 62; 204/192 P

[56] References Cited

U.S. PATENT DOCUMENTS 3,941,593 3/1976 Butement ..... 430/66
3,955,976 5/1976 Honjo et al. ..... 430/69
4,147,667 4/1979 Chevallier et al. ..... 430/84 X
4,225,222 9/1980 Kempter ..... 430/84

FOREIGN PATENT DOCUMENTS 2855718 6/1979 Fed. Rep. of Germany ..... 430/84

OTHER PUBLICATIONS

Moustakas et al., *Preparation of Highly Photoconductive Amorphous Silicon by rf Sputtering,* Solid State Comm., vol. 23, 1977.

Thompson et al., rf Sputtered Amorphous Silicon Solar Cells, Reidel Publishing Co., 1978.

*Primary Examiner*—John E. Kittle
*Assistant Examiner*—John L. Goodrow
*Attorney, Agent, or Firm*—Fitzpatrick, Cella, Harper & Scinto

[57] ABSTRACT

An electrophotographic photosensitive member for forming a potential image utilizing the difference in voltage distribution resulting from the change in resistance of a photoconductive layer. The photosensitive member is featured in forming a high-contrast potential image by the use of amorphous silicon for the photoconductive layer.

13 Claims, 13 Drawing Figures

PHOTOSENSITIVE MEMBER FOR ELECTROPHOTOGRAPHY COMPOSED OF A PHOTOCONDUCTIVE AMORPHOUS SILICON

BACKGROUND OF THE INVENTION

1. Field of the Invention

The present invention relates to a photosensitive member for use in an electrophotographic process, and more particularly to such photosensitive member for forming a potential image utilizing the difference in voltage distribution resulting from the change in resistance of a photoconductive layer.

2. Description of the Prior Art

In the field of electrophotography there are already known various photosensitive members. In a most common electrophotographic process consisting of an electrostatic charging step followed by an imagewise exposure step to form an electrostatic image, the representative photosensitive member is composed of a substrate and a photoconductive layer formed thereon. The photoconductive layer can be obtained by vacuum vapor deposition of inorganic photoconductive materials such as S, Se, PbO or alloys or intermetallic compounds of S, Se, Te, As or Sb, or by a coating of a mixture of inorganic photoconductive material such as ZnO, CdS, $TiO_2$ or PbO and an insulating binder.

The insulating binder can be composed of various resins.

The electrostatic image is generally obtained by charging the surface of the photosensitive member with a corona discharge, and then selectively dissipating the surface charge in areas exposed to a light image. The electrostatic image thus obtained is rendered visible by depositing toner particles having a charge of a polarity opposite to that of the electrostatic image, and is then transferred onto a transfer sheet. In such electrophotographic process, compacting of the apparatus is known to be difficult because of the presence of the wire and shield case for corona discharge, and of the high-voltage source therefor.

Also there are already proposed photosensitive members enabling to easily compact the apparatus, such as those disclosed in the Japanese Patents Laid-Open Sho 48-68238, Sho 51-150342, Sho 53-1027, Sho 54-61534 and Sho 54-61537. These photosensitive members are capable of forming a potential image developable with charged toner without the use of corona charging. The potential image is formed by imagewise exposure while a voltage is applied to the photoconductive layer through electrodes provided thereon, whereby a difference in voltage distribution is created between the exposed area and the unexposed area. The photoconductive layer to be employed in the photosensitive member for forming such potential image can be composed of the same materials as those employed in the photoconductive layer of the conventional photosensitive member, but differs in function from the latter.

In case of formation of electrostatic image utilizing corona charging, the exposed area of the photoconductive layer is rendered electroconductive to dissipate the charge, but, in the unexposed area the photoconductive layer has to maintain the insulating property in order to prevent charge dissipation. For this reason the photoconductive layer should be of as high resistance as possible. On the other hand, in case of forming a potential image through the difference in voltage distribution caused by a change in the resistance of the photoconductive layer, although the photoconductive layer is required to perform a distinct change in resistance in response to light, the absolute resistance need not be as high as in the formation of electrostatic image by corona charging, and the photoconductive layer is required to form ohmic contacts with electrodes, that is the photoconductive layer is such that a barrier (contact potential difference) between the photoconductive layer and the electrodes is as small as possible. This is due to the fact that the formation of a high-contrast potential image becomes difficult in case of a large barrier, since in such case the voltage drop resulting from said barrier reduces the voltage to be distributed. In this regard the Se-based photoconductive layer certainly has a high resistance, but is insufficient with respect to the ohmic contact property. Also the binder-containing photoconductive layers such as those based on CdS, CdSe, ZnO etc. have a high photosensitivity, but generate polarization under the application of a voltage due to the presence of the binder, thus resulting in gradually deteriorated contrast of the formed potential image when the voltage application is repeated. Besides the surface irregularity tends to deteriorate the image quality.

Also the photosensitive member to be employed in the formation of the potential image requires patterned electrodes such as isolated electrodes as will be explained later, and the photoconductive layer is required to have a sufficient resistance against heat and solvent involved in the vacuum vapor deposition or chemical etching in case such treatments are used in the preparation of such patterned electrodes.

The Se-based photoconductive layers and the binder-containing photoconductive layers are defective with regard to the head resistance and the solvent resistance, respectively.

SUMMARY OF THE INVENTION

The principal object of the present invention is to provide a photosensitive member adapted for use in the formation of the potential image and not associated with the abovementioned drawbacks.

Another object of the present invention is to provide a photosensitive member capable of providing a potential image of elevated contrast.

The present invention provides an electrophotographic photosensitive member in which the photoconductive layer having electrodes is subjected to imagewise exposure under the application of a voltage, thereby generating a difference in distributed voltage between the exposed and unexposed areas due to the change in resistance in the exposed area of said photoconductive layer, thus creating a potential image by the difference in surface potential corresponding to said difference of the distributed voltage, wherein the photoconductive layer is principally composed of amorphous silicon.

DESCRIPTION OF THE PREFERRED EMBODIMENTS

Figure 1:
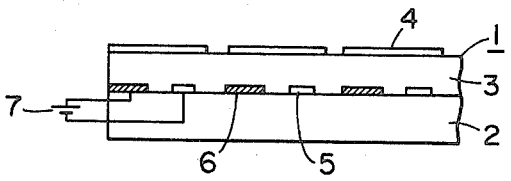
FIG. 1 is an embodiment of the photosensitive member according to the present invention.
Figure 2:
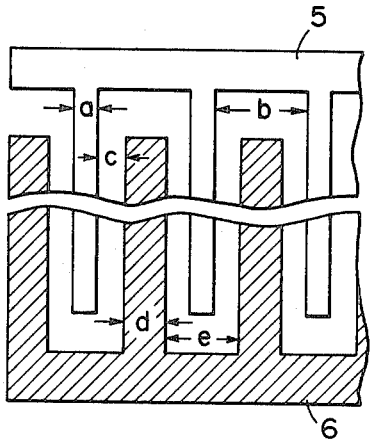
FIGS. 2 and 3 show the shape of the electrodes employed in the photosensitive member illustrated in FIG. 1.

The photoconductive layer composed of amorphous silicon can provide satisfactory ohmic contact with the electrodes and has a high photosensitivity, thus enabling the formation of the potential image of high contrast. Besides such photoconductive layer has sufficient resistance against heat and solvents, thus allowing to prepare the satisfactory photosensitive member without the deterioration of the photoconductive layer resulting from the formation of patterned electrodes. For example, the metal electrodes made of Pt or Au have to be prepared by evaporation by electron beams involving a high temperature because of the low vapor pressure of these metals, but the photoconductive layer composed of amorphous silicon is capable of withstanding a high temperature exceeding 400° C. Also it shows sufficient solvent resistance to the etching solution for various photoresists employed in the preparation of the patterned electrodes. Furthermore the photoconductive layer composed of amorphous silicon has an excellent response of resistance change to light, and is adapted for high-speed repetitive use of the photosensitive member. It also has a high mechanical strength and is not damaged by fur brush or blade used in the development or cleaning step in the visible image forming process. FIG. 1 shows the representative structure of the photosensitive member of the present invention. In the following description the amorphous silicon will be abbreviated as "a-Si", and the amorphous silicon photoconductive layer as "a-Si layer". The photosensitive member shown in FIG. 1 is composed of a substrate 2, an a-Si photoconductive layer 3, isolated conductors 4, light transmissive electrodes (irrespective of being transparent or not) (hereinafter referred to as "translucent electrodes") 5 and opaque electrodes 6, in which said translucent electrodes 5 and opaque electrodes 6 are formed on the substrate 2 with comb patterns as shown in FIG. 2.

Isolated electrodes 4 are conductors constituting discontinuous islands for forming the image elements to be formed. Said isolated conductors have a pattern of separated squares as shown in a plan view in FIG. 3.

The substrate is translucent and can be composed, for example, of glass or resin. The translucent and opaque electrodes can be prepared by various methods, of which a representative one is based on vacuum vapor deposition and chemical etching utilizing a photoresist. In this method a material for forming the translucent electrodes, such as $In_2O_3$, $SnO_2$, In-Sn-O etc., is deposited by evaporation onto the surface of the substrate, and a comb-shaped masking pattern is formed with a photoresist. After selective removal of said material, e.g. $In_2O_3$ layer with an etching solution such as an acid or an alkali, said photoresist masking layer is removed to obtain the translucent electrodes. The opaque electrodes are also formed on the substrate in the same manner. The opaque electrodes can be made of various metals such as Al, Ag, Pb, Zn, Ni, Au, Cr, Mo, Ir, Nb, Ta, U, Ti, Pt etc. which can be deposited as a layer by means of vapor deposition, electron beam evaporation or sputtering.

In the present invention, any photoresist commonly used can be employed for the purpose. The examples of commercially available photoresists are: KPR (Kodak Photo Resist, produced by Kodak Company and Developable with methylene chloride or trichlene), KMER (Kodak Metal Etch Resist, produced by Kodak Company and developable with xylene or trichlene), TPR (produced by Tokyo Oka Co. and developable with xylene or trichlene), Shipley AZ1300 (produced by Shipley Company and developable with aqueous alkali solution), KTFR (Kodak Thin Film Resist, produced by Kodak Company and developable with xylene or trichlene), FNRR (produced by Fuji Chemical Co. and developable with chlorocene), FPER (Fuji Photo Etching Resist, produced by Fuji Photo Film Co. and developable with trichlene), TESH DOOL (produced by Okamoto Chemical Industries Co. and developable with water), and Fuji Resist No. 7 (produced by Fuji Chemical Co. and developable with water). The removal of the photoresist after etching can be achieved with trichlene, methylene chloride, AZ Remover (produced by Shipley Co.) or sulfuric acid.

The translucent and opaque electrodes can also be formed by vapor-depositing the materials for said electrodes on the substrate through masks with comb-shaped apertures, followed by mask removal.

The thickness of the translucent electrodes is generally in a range of 500 to 6000 Å, while that of the opaque electodes is generally in a range of 500 Å to 2μ.

The a-Si layer is formed after the preparation of the translucent and opaque electrodes.

The a-Si layer is formed by a suitable depositing method such as glow discharge, sputtering, ion plating or vacuum vapor deposition.

The glow discharge, sputtering and ion plating are depositing methods utilizing electric discharge, and the a-Si layer of a desired thickness is obtained by maintaining a gas plasma atmosphere for a predetermined period of time in the depositing chamber.

The a-Si layer may be formed from silicon element or a silicon compound liberating silicon upon decomposition during the deposition. The representative examples of such silicon compound are silicon hydrides such as $SiH_4$, $Si_2H_6$ etc. At the formation of the a-Si layer, if desired, the addition of hydrogen, oxygen, nitrogen and/or carbon may be effective for controlling the dark resistance and photoelectric gain of said layer.

Hydrogen can be incorporated into the a-Si layer at the growth thereof through decomposition by gas discharge of $SiH_4$, $Si_2H_6$ etc. or hydrogen introduced in the depositing apparatus.

In case silicon hydride such as $SiH_4$ or $Si_2H_6$ is employed for preparing the a-Si layer, it is not necessary to add silicon element or other silicon compounds since the silicon present in said hydride can be utilized as the principal component for forming the a-Si layer, but such addition may be effected, if necessary. The quantity of hydrogen contained in the a-Si layer is generally selected within a range of 10 to 40 atomic %, preferably in a range of 15 to 30 atomic %. The incorporation of hydrogen into the a-Si layer can be realized automatically, for example, in the glow discharge method, at the formation of the a-Si layer, by the decomposition of hydrides such as $SiH_4$ or $Si_2H_6$ utilized as the starting material for forming said layer, but such incorporation can be conducted more effectively by introducing hydrogen or argon gas into the glow discharge apparatus at the formation of said a-Si layer.

Also in the sputtering method, such hydrogen incorporation can be achieved by, in the sputtering process with silicon target in an atmosphere of an inert gas such as argon or an inert gas-based mixture, introducing hydrogen gas or gaseous silicon hydride such as $SiH_4$ or $Si_2H_6$, or another gas such as $B_2H_6$ or $PH_3$ which also serves for impurity doping.

The incorporation of oxygen, nitrogen or carbon into the a-Si layer can also be realized in the same manner as the incorporation of hydrogen, utilizing elementary oxygen, nitrogen or carbon, or the compounds thereof. The examples of such oxygen compound are $SiO_2$, $Si_3N_4CO$ and $CO_2$ and the examples of such nitrogen compound are NO, $NO_2$ and $NH_3$. Also the examples of such carbon compound are saturated hydrocarbons containing 1 to 4 carbon atoms such as methane ($CH_4$), ethane ($C_2H_6$), propane ($C_3H_8$), n-butane (n-$C_4H_{10}$) etc.; ethylenic hydrocarbons containing 1 to 4 carbon atoms such as ethylene ($C_2H_4$), propylene ($C_3H_6$), butene-1 ($C_4H_8$), butene-2 ($C_4H_8$) or isobutylene ($C_4H_8$); and acetylenic hydrocarbons containing 2 to 3 carbon atoms such as acetylene ($C_2H_2$) or methylacetylene ($C_3H_4$). The photoconductive a-Si layer can be obtained by effecting glow discharge in a depositing chamber which is charged with a gas for forming the a-Si layer and oxygen, nitrogen or gaseous compounds of oxygen, nitrogen or carbon under a reduced pressure. Also the sputtering formation of the photoconductive layer can be achieved by sputtering with a mixed target, for example, of (Si+C), (Si+$SiO_2$) or (Si+$Si_3N_4$), or with two targets of Si and C, $SiO_2$ or $Si_3N_4$ respectively, or by sputtering with a Si target and in a sputtering gas such as argon mixed with oxygen, nitrogen or a gaseous compound of oxygen, nitrogen or carbon.

The content of oxygen, nitrogen or carbon in the a-Si layer can be suitably determined, but is generally selected in a range of 0.1 to 30 atomic %, preferably in a range of 0.1 to 20 atomic % and most preferably in a range of 0.2 to 15 atomic %.

In the preparation of the a-Si layer by deposition utilizing electric discharge, the effective discharge for generating suitable plasma atmosphere can be advantageously caused by an AC or DC current of a density within a range of 0.1 to 10 mA/cm$^2$, preferably within a range of 1 to 5 mA/cm$^2$, and a voltage from 100 to 500 V, preferably from 300 to 500 V is utilized to cause a power consumption of 0.1 to 50 W, preferably 0.5 to 10 W.

Also suitable impurity doping may be effected to form an a-Si layer of intrinsic semiconductor type or to control the type of conductivity thereof. The preferred examples of such impurity for obtaining P-type a-Si layer are the elements of the group IIIA in the periodic table, such as B, Al, Ga, In, Tl etc., while those for obtaining N-type layer are the elements of the group VA in the periodic table, such as N, P, As, Sb, Bi etc.

The method of doping these impurities into the a-Si layer depends on the process of preparation thereof and will be clarified further in the following description or in the following examples.

The thickness of the a-Si layer is suitably determined in consideration of the required electrophotographic properties and depending on other requirements for use, if any, for example, the flexibility of the photosensitive member, but is generally selected within a range of 1 to 100$\mu$.

On the a-Si layer, there are provided isolated conductors 4, which are formed in the same manner as the translucent and opaque electrodes and whose thickness is generally selected within a range from 500 Å to 2$\mu$.

Figure 4:
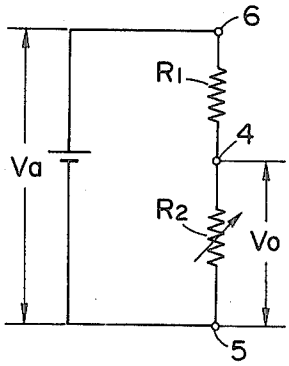
FIG. 4 is a diagram showing an equivalent circuit of the photosensitive member illustrated in FIG. 1.

The formation of a potential image by means of the photosensitive member shown in FIG. 1 will be clarified from the equivalent circuit thereof shown in FIG. 4, wherein a voltage Va of a voltage source 7 is applied between the translucent electrodes and opaque electrodes.

$R_1$ is the resistance between the opaque electrode and the isolated conductor 4, and $R_2$ is the resistance between the isolated conductor 4 and the translucent electrode 5. The potential Vo of the isolated conductor 4 is equal to the voltage applied between the translucent electrode 5 and the isolated conductor 4 and can be represented by the following equation:

$$Vo = \frac{R_2}{R_1 + R_2} Va \quad (1)$$

In response to the imagewise exposure through the substrate in the presence of said applied voltage Va., there is generated a difference in the potential of the isolated conductor between the exposed area and the unexposed area.

In the exposed area, the resistance $R_2$ in the a-Si layer between the opaque electrode and the isolated conductor remains unchanged as said layer is shielded by said opaque electrode and is not exposed to the light, but the resistance $R_2$ between the translucent electrode and the isolated conductor is reduced since the a-Si layer in this portion is exposed to the light. Consequently the potential of the isolated conductor is reduced as represented by the following equation (2) obtained by the modifying the foregoing equation (1):

$$Vo = \frac{1}{R_1/R_2 + 1} Va \quad (2)$$

On the other hand, the potential of the isolated conductor remains unchanged in the unexposed area since there is no change in $R_1$ or $R_2$. In this manner, there is obtained a potential image having lower and higher potentials respectively in the exposed and unexposed areas. Also an inverted image can be obtained by inverting the applied voltage.

The potential image thus formed can be developed with an already known electrophotographic developing method and can then be transferred onto a transfer sheet.

Figure 5:
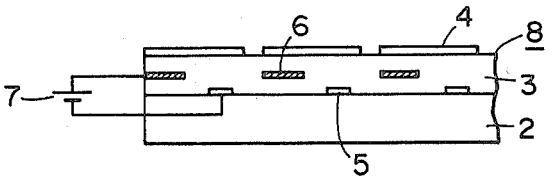
FIGS. 5, 6 and 7 respectively show other embodiments of the photosensitive member of the present invention.
Figure 6:
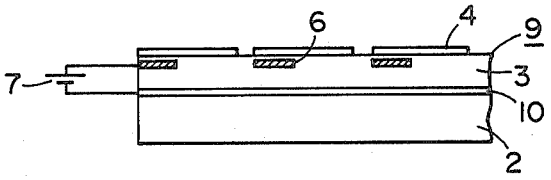
Figure 7:
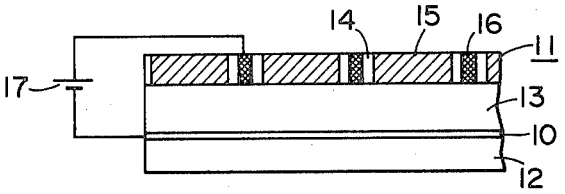

In addition to the foregoing embodiment shown in FIG. 1, the photosensitive member of the present invention can be realized in other various embodiments, as exemplified in FIGS. 5, 6 and 7.

Figure 8:
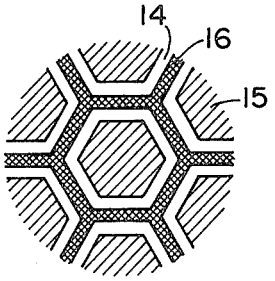
FIG. 8 is a view showing the shape of the electrodes employed in the photosensitive member shown in FIG. 7.

In order to obtain the potential image of an elevated contrast the resistance $R_1$ should be advantageously selected small as represented in the equation (2), and, for this reason the photosensitive member 8 shown in FIG. 5 is provided with opaque electrodes 6 inside the a-Si layer for reducing said resistance $R_1$. Also the photosensitive member 9 shown in FIG. 6 is provided with the opaque electrodes 6 in the upper portion of the a-Si layer, and with the translucent electrode 10 not in patterned form, but in continuous form for facilitating the preparation thereof. In photosensitive member 11 shown in FIG. 7 a voltage source 17 is connected between the translucent electrode 10 and a mesh electrode 16. 12 and 13 respectively indicate the substrate and the a-Si layer, and provided thereon are isolated conductors 15, a resistor layer 14 and a mesh electrode 16, as shown in a plan view in FIG. 8. Said resistor layer may be composed for example of $SiO_2$, $TiO_2$, CdO, ZnS or polyvinylcarbazole (PVK).

In the photosensitive member shown in FIG. 7, the resistance between said mesh electrode 16 and the isolated conductor 15 corresponds to $R_1$ in the equivalent circuit of FIG. 4, and the resistance between the isolated conductor 15 and the translucent electrode 10 corresponds to $R_2$ in FIG. 4.

It is furthermore possible, in the present invention, to provide a photosensitive member capable of forming a potential image of elevated contrast by the use of combination of an N-type a-Si layer and a P-type a-Si layer as the photoconductive layer. In the exposed area of such photosensitive member, the barrier reduction at the PN junction contributes, in addition to the resistance reduction by the photocarriers, to the decrease of resistance in the photoconductive layer. On the other hand, in the unexposed area, there is maintained a high resistance by the PN junction, and the difference between such high and low resistance respectively in the exposed and unexposed areas creates a marked difference in the surface potential, thus generating the potential image of an elevated contrast.

Figure 9:
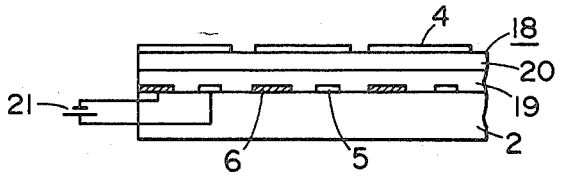
FIGS. 9, 10, 11, 12 and 13 respectively show other embodiments of the photosensitive member of the present invention.

A representative structure of such photosensitive member is shown in FIG. 9, wherein said member 18 is modified from that shown in FIG. 1, in that the photoconductive layer comprises a PN junction, and is composed of a substrate 2, an N-type a-Si layer 19, a P-type a-Si layer 20, isolated conductors 4, translucent electrodes 5 and opaque electrodes 6. 21 indicates a voltage source.

The preferred examples of the doping material for obtaining the P-type a-Si layer are the elements of group IIIA of the periodic table such as B, Al, Ga, In, Tl etc., while those for obtaining the N-type a-Si layer are the elements of group VA of the periodic table such as N, P, As, Sb, Bi etc.

The quantity of the impurity doped into the a-Si layer is suitably determined in consideration of the desired electric and optical properties, but is generally selected within a range from $10^{-4}$ to 1 atomic %, preferably from $10^{-2}$ to 1 atomic % for the impurities of group IIIA of the periodic table, and within a range from $10^{-4}$ to 1 atomic %, preferably from $10^{-2}$ to 1 atomic % for the impurities of group VA of the periodic table.

The thickness of said N-type and P-type a-Si layers can be suitably determined but is advantageously selected within a range from 0.5 to 50$\mu$.

The photosensitive member shown in FIG. 9 is also represented by the equivalent circuit shown in FIG. 4, in which however the resistance $R_2$ in the unexposed area can be made even larger by the electric barrier of the PN junction present in the photoconductive layer while the resistance $R_2$ in the exposed area can be made even smaller due to the dissipation of said barrier, whereby the potential difference in the potential of the isolated conductors between the exposed and unexposed areas becomes more eminent. In order to effectively utilize the barrier of said PN junction, positive and negative voltages are advantageously applied respectively to the translucent electrodes and to the opaque electrodes as shown in FIG. 9. In this manner the PN junction between the opaque electrode and the isolated conductor receives a forward potential to reduce the resistance $R_1$, while the junction between the isolated conductor and the translucent electrode receives an inverse potential to increase the resistance $R_2$ when not exposed to the light. As the result, as will be understood from the foregoing equation (2), the fixed resistance $R_1$ is selected smaller while the variable resistance $R_2$ changes from a larger value to a small value upon exposure, whereby the isolated conductor undergoes a larger potential change in response to the exposure to provide a potential image of an elevated contrast. In case said N-type and P-type a-Si layers are provided in the inverted order, the polarity of the voltages to be applied to the translucent and opaque electrodes should likewise be inverted.

Figure 10:
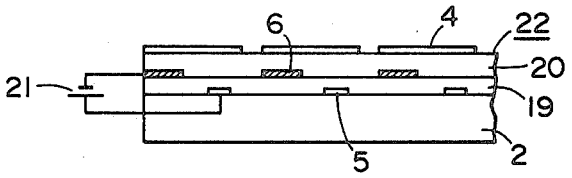
Figure 11:
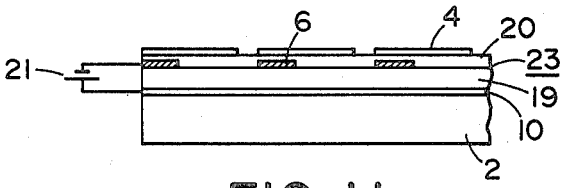

FIGS. 10, 11, 12 and 13 show other embodiments of the photosensitive member having a PN junction in the photoconductive layer. In order to obtain the potential image of an elevated contrast, the resistance $R_1$ should be selected small as will be understood from the equation (2), and, for this reason the photosensitive member 22 shown in FIG. 10 is provided with the opaque electrodes 6 positioned between the N-type and P-type a-Si layers for reducing said resistance $R_1$. The photosensitive member 23 shown in FIG. 11 is provided with the opaque electrodes 6 in the upper portion of the photoconductive layer and with a translucent electrode 10 not in patterned form, but in continuous form for facilitating the preparation thereof.

Figure 12:
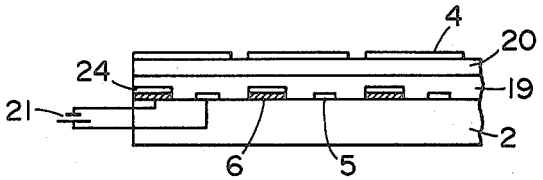
Figure 13:
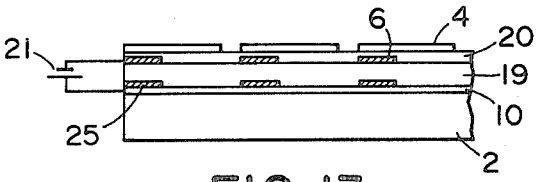

Also the photosensitive member shown in FIG. 12 is provided with a resistor layer 24 on the opaque electrode 6 for increasing the resistance between the opaque electrodes 6 and the isolated conductors 4 thereby preventing the current loss. Said resistor layer may be composed of a Ni-Cr alloy, $SiO_2$, $TiO_2$, CdO, ZnS, polyvinylcarbazole etc. The photosensitive member shown in FIG. 13 is an improvement in that shown in FIG. 11 and is provided with an opaque layer 25 of a shape corresponding to that of the opaque electrodes in order to prevent excessive current resulting from the decrease in resistance between the opaque electrodes 6 and the translucent electrode 10 at the exposure. Such opaque layer may be composed either of the same material as the opaque electrodes or of a printed ink. Also in the photosensitive member of FIG. 7 the a-Si layer can be effectively replaced by laminated a-Si layers of N-type and P-type.

Also in the embodiments shown in FIGS. 9–13, the illustrated structure of the N-type photoconductive layer covered by the P-type photoconductive layer may be inverted.

It is furthermore possible to employ a laminate structure which contains at least two N-type photoconductive layers and/or at least two P-type photoconductive layers and in which said N-type and P-type layers are alternated. In such case, there are formed at least two PN junctions.

In the foregoing embodiments the isolated conductors and other patterned electrodes are not limited to rectangular, hexagonal or comb forms but may assume other suitable forms.

EXAMPLE 1

On a glass substrate, $In_2O_3$ was vapor-deposited in the thickness of 2000 Å by electron beam, and a photoetching process utilizing an ordinary photoresist was effected to form the translucent electrodes as shown in FIG. 2 (a=20μ, b=110μ). Subsequently aluminum was evaporated in a thickness of 1μ through a metal mask to obtain opaque electrodes as shown in FIG. 2 (c=30μ, d=50μ, e=80μ). Then formed thereon was an a-Si layer in a vacuum jar filled with a gas ($SiH_4$/Ar=1/9) at a pressure of $10^{-2}$ mmHg. In said jar, on both sides of the glass substrate there were provided two flat electrodes at a distance of 3 cm from the glass substrate, and across said electrodes there was applied a high frequency of 13.55 MHz to cause a plasma discharge therebetween. During the discharge said gas ($SiH_4$/Ar) was made to flow at a speed of 1 cc/sec, and the glass substrate was maintained at a temperature of 150° C. After the discharge for 5 hours there was formed an a-Si layer of a thickness of 10μ, having a dark resistance of $5\times10^{-7}\Omega$.cm which was reduced to $2\times10^{3}\Omega$.cm upon exposure to visible light of 10 lux.

Figure 3:
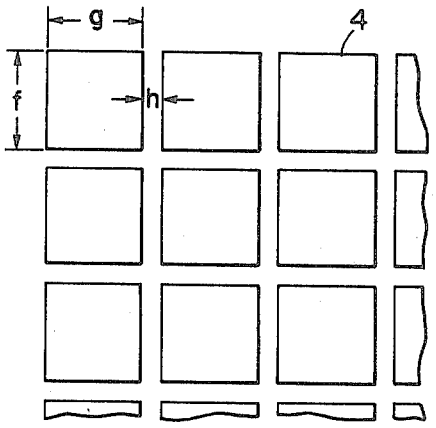

Subsequently the isolated conductors as shown in FIG. 3 (f=g=100μ, h=30μ) were formed by vapor-depositing aluminum on the a-Si layer through a metal mask. The photosensitive member as shown in FIG. 1 was completed in this manner.

A DC voltage of 100 V was applied between the translucent electrodes and the opaque electrodes, and the photosensitive member was subjected to an imagewise exposure through the glass substrate. The obtained image was developed with toner to provide a clear image with a resolving power of 5 lines/mm.

The obtained potential image showed a contrast of 70 V between the light and dark areas. Also the surface potential of the photosensitive member showed complete compliance even when the image exposures were repeated at a frequency of 50 times/sec.

EXAMPLE 2

Onto a glass substrate $In_2O_3$ was uniformly vapor-deposited to obtain a translucent electrode of a thickness of 3000 Å, onto which was subsequently formed an a-Si layer of a thickness of 10μ in a similar manner as described in Example 1. On said layer Mo was vapor-deposited by electron beam in the thickness of 1μ, and was etched as described in Example 1 to form the opaque electrodes as shown in FIG. 2 (d=20μ, e=30μ). The etching of molybdenum was effected with a mixture of potassium ferricyanide, potassium hydroxide and ammonium oxalate. Subsequently an a-Si layer of a thickness of 1μ was formed again, and formed thereon were isolated conductors of molybdenum same as those in Example 1 (f=g=50μ, h=30μ) by the above-explained etching process, thereby providing the photosensitive member as shown in FIG. 6.

A voltage of 100 V was applied between the translucent electrode and the opaque electrodes of said photosensitive member, and an imagewise exposure was effected to obtain a potential image with a contrast of 90 V. The toner development thereof provided a clear image with a resolving power of 7 lines/mm.

EXAMPLE 3

Onto a glass substrate $In_2O_3$ was vapor-deposited in a thickness of 2000 Å by electron beam, and was subjected to photoetching utilizing an ordinary photoresist to obtain translucent electrodes as shown in FIG. 2 (a=40μ). Subsequently aluminum was vapor-deposited in the thickness of 1μ through a metal mask to obtain opaque electrodes as shown in FIG. 2 (d=80μ, c=40μ). Then an N-type a-Si layer was formed by the glow discharge method, in which the glass substrate was placed in a vacuum jar filled with a 1:9 mixed gas of $SiH_4$ and Ar containing $PH_3$ in 0.2 vol.% based on $SiH_4$ at a pressure of 0.1-1 torr, and a high frequency field of 13.56 MHz was applied across two flat electrodes placed on both sides of said glass substrate at a distance of 3 cm therefrom. The glass substrate was maintained at a temperature of 250° C., and the discharge was continued for 3 hours to obtain an deposited layer of 3μ. Subsequently effected thereon was the formation of a P-type a-Si layer, in which used instead was a 1:9 mixed gas of $SiH_4$ and Ar containing $B_2H_6$ in 0.3 vol.%. A thickness of 5μ was obtained after 5 hours. Subsequently there were formed isolated conductors as shown in FIG. 3 (f=180μ, h=20μ) by depositing aluminum onto said a-Si layer through a metal mask, thus completing the photosensitive member as shown in FIG. 9.

The translucent electrode of said photosensitive member was grounded while a DC voltage of −50 V was applied to the opaque electrode, and the imagewise exposure was effected through the glass substrate. The toner development of the obtained image provided a clear image with a resolving power of 2.5 lines/mm.

The obtained potential image showed a contrast of 40 V between the light and dark areas. No deterioration in image quality was observed after the above-mentioned process was repeated 10,000 times.

Also the surface potential showed perfect compliance even when light pulses of a duration of 100μ sec. were irradiated at a frequency of 1 KHz.

Furthermore, in the present example, comparable results were obtained by using $AsH_3$, $Sb(CH_3)_3$ or $Bi(CH_3)_3$ in place of $PH_3$.

What we claim is:

1. An electrophotographic photosensitive member adapted for use in an electrophotographic process in which a photoconductive layer having electrodes is subjected to imagewise exposure in the presence of a voltage to generate a difference in the distributed voltage between the exposed and unexposed areas due to the change in resistance in the exposed area of said photoconductive layer thereby creating a potential image by the difference in surface potential corresponding to said difference in the distributed voltage, which comprises a photoconductive layer principally composed of amorphous silicon, a number of electrically isolated conductors formed on the surface of the photoconductive layer, and one pair of electrodes arranged at the photoconductive layer, said one pair of electrodes arranged in such a way that a potential applied between said one pair of electrodes can be distributed through each of said isolated conductors.

2. An electrophotographic photosensitive member according to claim 1, wherein said photoconductive layer is principally composed of amorphous silicon containing hydrogen.

3. An electrophotographic photosensitive member according to claim 2, wherein said amorphous silicon contains hydrogen in an amount of 10 to 40 atomic %.

4. An electrophotographic photosensitive member according to claim 1, wherein said photoconductive layer is composed of a laminated structure of at least one N-type amorphous silicon layer and at least one P-type amorphous silicon layer.

5. An electrophotographic photosensitive layer according to claim 4, wherein said N-type amorphous silicon layer is doped with an element of group VA of the periodic table.

6. An electrophotographic photosensitive layer according to claim 4, wherein said P-type amorphous silicon layer is doped with an element of group IIIA of the periodic table.

7. An electrophotographic photosensitive member according to claim 1, wherein said electrophotographic photosensitive member comprises a substrate, a light translucent electrode provided on a surface of said substrate, a light opaque electrode, said amorphous silicon layer provided on said surface of said substrate and said electrically isolated conductors provided on the upper surface of said amorphous silicon layer away from said substrate.

8. An electrophotographic photosensitive member according to claim 7, wherein said opaque and translucent electrodes are patterned electrodes.

9. An electrophotographic photosensitive member according to claim 7, wherein said translucent electrode is a continous electrode provided on said surface of said substrate and wherein said opaque electrode is a patterned electrode.

10. An electrophotographic photosensitive member according to claim 7, wherein each of said opaque and translucent electrodes are patterned electrodes provided on said surface of said substrate.

11. An electrophotographic photosensitive member according to claim 7, wherein said opaque electrode is provided within said amorphous layer.

12. An electrophotographic photosensitive member according to claim 11, wherein said opaque electrode is provided in the upper portion of said amorphous silicon layer away from said substrate.

13. An electrophotographic photosensitive member according to claim 8, further comprising a resistor layer on the upper surface of said opaque electrode away from said substrate.

* * * * *